US009044773B2

(12) United States Patent
Pek

(10) Patent No.: US 9,044,773 B2
(45) Date of Patent: Jun. 2, 2015

(54) DEVICE WITH SLOTTED NOZZLE ASSEMBLY FOR DISPENSING FLUID

(75) Inventor: Robert Pek, Neetze (DE)

(73) Assignee: Nordson Corporation, Westlake, OH (US)

( * ) Notice: Subject to any disclaimer, the term of this patent is extended or adjusted under 35 U.S.C. 154(b) by 1155 days.

(21) Appl. No.: 11/953,992

(22) Filed: Dec. 11, 2007

(65) Prior Publication Data

US 2008/0156904 A1 Jul. 3, 2008

(30) Foreign Application Priority Data

Dec. 29, 2006 (DE) ..... 20 2006 019 724 U

(51) Int. Cl.
*B05C 5/02* (2006.01)
*B05B 15/06* (2006.01)

(52) U.S. Cl.
CPC ..... *B05C 5/0266* (2013.01); *B05B 15/06* (2013.01)

(58) Field of Classification Search
None
See application file for complete search history.

(56) References Cited

U.S. PATENT DOCUMENTS

| | | | | |
|---|---|---|---|---|
| 3,583,032 | A | 6/1971 | Stafford | |
| 4,348,346 | A | 9/1982 | Thompson | |
| 4,454,084 | A | 6/1984 | Smith et al. | |
| 4,512,945 | A * | 4/1985 | Vigano | 264/263 |
| 5,277,344 | A * | 1/1994 | Jenkins | 222/504 |
| 5,389,151 | A * | 2/1995 | Fort | 118/411 |
| 5,614,260 | A * | 3/1997 | Darcy | 427/277 |
| 5,679,387 | A * | 10/1997 | Cloeren et al. | 425/381 |
| 5,862,986 | A * | 1/1999 | Bolyard et al. | 239/135 |
| 6,089,413 | A * | 7/2000 | Riney et al. | 222/318 |
| 6,422,428 | B1 * | 7/2002 | Allen et al. | 222/318 |
| 6,689,214 | B2 | 2/2004 | Burmester et al. | |
| 2002/0026897 | A1 * | 3/2002 | Burmester et al. | 118/313 |
| 2003/0194481 | A1 | 10/2003 | Lippelt | |
| 2004/0241327 | A1 | 12/2004 | Wyatt et al. | |
| 2005/0045095 | A1 * | 3/2005 | Pahl | 118/313 |
| 2005/0242108 | A1 * | 11/2005 | Harris et al. | 222/1 |

FOREIGN PATENT DOCUMENTS

| | | |
|---|---|---|
| DE | 10001391 A1 | 7/2001 |
| DE | 10253410 | 1/2004 |
| EP | 0104089 B1 | 3/1984 |

(Continued)

OTHER PUBLICATIONS

English Translation of Latorre DE10253410, published Jan. 4, 2004.*

(Continued)

*Primary Examiner* — Charles Capozzi
(74) *Attorney, Agent, or Firm* — Wood, Herron & Evans, L.L.P.

(57) ABSTRACT

A device for dispensing fluid onto a substrate that is movable relative to the device. The device includes a basic body that has a fluid supply channel which is connectable to a fluid source. A slotted nozzle assembly communicates with the fluid supply channel. The slotted nozzle assembly is formed on or attached to the basic body and has a slot-shaped discharge opening for dispensing the fluid. A fluid valve selectively interrupts or releases the fluid stream. The basic body and/or the slotted nozzle assembly have a plurality of segments which are situated adjacent to each other in the direction of the longitudinal extension of the slot-shaped discharge opening.

13 Claims, 6 Drawing Sheets

(56) References Cited

FOREIGN PATENT DOCUMENTS

| | | | |
|---|---|---|---|
| EP | 1134066 | A2 | 9/2001 |
| FR | 1415447 | | 10/1965 |
| GB | 914010 | | 12/1962 |
| JP | 59-73076 | A | 4/1984 |
| JP | 10005662 | A | 1/1998 |
| JP | 11165098 | A | 6/1999 |
| JP | 2002543967 | A | 12/2002 |
| JP | 2004948 | | 1/2004 |
| WO | 00/67914 | A2 | 11/2000 |
| WO | 0078849 | A1 | 12/2000 |

OTHER PUBLICATIONS

European Patent Office, European Search Report in EP Appl. No. 07123767.1, Dec. 14, 2009.
European Patent Office, Examination Report in EP Application No. 07123767.1, Dec. 3, 2013.
Japanese Patent Office, Notification of Reason for Refusal in JP Application No. 2007-336387, Dec. 11, 2012.
European Patent Office, Examination Report in EP Application No. 07123767.1, Feb. 5, 2013.

* cited by examiner

DEVICE WITH SLOTTED NOZZLE ASSEMBLY FOR DISPENSING FLUID

The present application claims the priority of German Utility Model Application No. 202006019724.9 filed Dec. 29, 2006 (now German Utility Model Patent No. 202006019724.9) under 35 U.S.C. §119. The disclosure of that priority application is hereby fully incorporated by reference herein.

TECHNICAL FIELD

The present invention relates to a device for dispensing fluid onto a substrate that is movable relative to the device, in particular for dispensing adhesive.

BACKGROUND

Devices of the type disclosed are often also referred to as application heads, and have a slotted nozzle with a longitudinal slot-shaped discharge opening from which a fluid such as adhesive is applied extensively to various substrates. For example, packaging materials, furniture parts, films, hygiene products or the like can be coated extensively with adhesive or other fluids flowing from the discharge opening.

The basic body that has the fluid supply channel is normally connected to a fluid source, for example, in the form of an adhesive melting device, so that liquid adhesive can be fed into the supply channel by means of a pump. When the fluid valve is open, the adhesive flows into the nozzle system and is dispensed through the slot-shaped discharge opening and applied to the substrate. This can occur by a contact process or without the nozzle system contacting the substrate.

A slotted nozzle system is known from WO 00/67914, in which the length of the slot is variable by means of a closing piece that is movable in the slot and blocks the slot off laterally. The effective length of the slot can be varied in this way.

To adjust the maximum length of the slot-shaped discharge opening, and thus the maximum effective width of the fluid application, the entire application head is produced in the length desired by the user, with a desired application width. The metal basic body and the nozzle assembly extend over the entire length of the device. Depending on the requirements, the basic body and the nozzle assembly are produced individually, which is expensive.

The object of the present invention is to provide a device for dispensing fluid by means of a slotted nozzle assembly that is adaptable to different application widths and thus to different user wishes in a simply designed manner.

SUMMARY

Generally, the invention provides the basic body and/or the slotted nozzle assembly with a plurality of segments which are situated adjacent to each other in the direction of the longitudinal extension of the slot-shaped discharge opening.

The segmented or modular construction of the basic body and/or of the slotted nozzle assembly makes it possible to adjust the length of the application width of the device, depending on the desire of the user, in a simply designed manner. Because of the modular or segmented construction of the basic body, for example, the number of basic body segments can be combined depending on the desired application width. The basic body segments can be installed side-by-side in a simple manner. The length of the slotted nozzle assembly can be adapted to the desired application width in a simple manner. Two variants can be selected: either a) in addition to the basic body, the slotted nozzle assembly is designed in modular or segmented form with a plurality of segments that are placed adjacent to each other in the direction of the longitudinal extension of the discharge opening, or b) the slotted nozzle assembly may not be of segmented design, but rather may extend essentially over the entire length of the slot-shaped discharge opening. Through the segmented construction of the basic body it is possible to achieve substantial advantages in adjustment technique, because not every order requires a complete basic body to be produced corresponding to the desired application width, but rather a complete application device can be assembled in the desired width from the prefabricated basic body segments. Simple disassembly of the device is also possible, if this should be necessary for purposes of cleaning or maintenance. The individual segments of the basic body or of the slotted nozzle assembly can be disassembled for this purpose.

A preferred exemplary embodiment of the invention proposes that a plurality of basic body segments be situated adjacent to each other, and that not all but only a few, in particular only one basic body segment, be connected to a fluid source to supply fluid. That fluid can be distributed by the basic body segment that is connected to the fluid source by means of a distribution channel that communicates with this basic body segment essentially over the longitudinal extent of all basic body segments. This further significantly simplifies the complexity of design. By particular preference, only one basic body segment is connected to a fluid source. The fluid is conducted from this basic body segment into the distribution channel, and is distributed from there over the entire application width of the slotted nozzle assembly. It is particularly preferred for the distribution channel to be designed inside of the nozzle assembly. As a result, not all of the basic body segments need to have fluid flowing through them, but rather the hydraulic components are positioned essentially in the nozzle assembly, with the exception of the basic body segment that is connected to the fluid source. This results in further simplifications; for example, only one fluid pump needs to be provided and less effort at sealing is needed.

A refinement of the invention proposes that the effective length of the distribution channel be adjustable by means of a closing piece which is movable and is situated and sealed in the distribution channel. That also permits a fine adjustment of the application width by the user, after the maximum application width has been determined by the choice of the basic body segments. Expediently, the closing piece has a section that extends in the direction of the slot-shaped discharge opening, which seals off the slot of the nozzle assembly laterally.

A simplification of design results when the nozzle system has two nozzle parts that extend essentially over the entire length of the plurality of basic body segments. Preferably, the distribution channel is made by recesses formed in the two nozzle parts, so that the distribution cannel can be produced simply, for example by milling.

It is especially preferred that a fluid valve be assigned to only one of the plurality of basic body segments, to selectively interrupt or release the fluid stream in the distribution channel. It is thus possible to optionally control the fluid stream with only one fluid valve, without need of assigning a valve to each individual segment. Optionally, the fluid valve may be situated on an end segment of the basic body, or alternatively on a middle basic body segment, and the fluid distributed from there. It is preferred that the fluid valve be situated at least partially inside a bore produced in the basic body segment. It is also preferred in particular that the basic body segments have two bores to receive the fluid valve, that a fluid valve be situated in one bore and that the other bore be closed by means of a plug. It is thus optionally possible during assembly for the fluid valve to be partially inserted into one of the bores according to the user's wish, without that bore first having to be produced individually, while the other bore can be closed and thus deactivated. That simplifies the assembly and the production effort.

Another preferred embodiment provides that the fluid valve has a movable valve body, that may be brought into contact with a valve seat formed on the basic body segment to interrupt the fluid stream, so that little design effort is needed to produce the fluid valve.

Expediently, attached to the basic body segment that has the fluid valve is a fluid filter, which is connected between the fluid source and the fluid supply channel.

Good installability and uninstallability result when the basic body segments are attached to a support profile, preferably being bolted on.

In addition, it is especially preferred that the basic body segments have a recess, within which the nozzle assembly is partially or essentially completely situated. By means of the prefabricated recess, for example a milled-out recess, the nozzle assembly can be attached to the basic body compactly and with protection. In particular if according to a refinement the basic body has a plurality of bores to receive heating cartridges for heating the basic body and the nozzle assembly, a favorable flow of heat from the basic body into the nozzle assembly results, so that the fluid that is to be dispensed, in particular a hot melt adhesive, maintains temperatures everywhere that are necessary for flow without solidifying.

An alternative embodiment proposes that holding elements be situated at both ends on the basic body or the support profile, to which a substrate guide device is attached to guide the substrate past the discharge opening of the slot along a defined motion path. All-in-all this results in a compact construction form with a variable substrate guide device.

It is especially preferred that the substrate guide device have a shaft that can pivot around an axis of rotation, so that at least one substrate guide element of the substrate guide device is situated so that it can pivot around the axis of rotation.

The invention is explained below on the basis of a plurality of preferred exemplary embodiments, with reference to the attached figures. The figures show the following:

DETAILED DESCRIPTION

Figure 1:
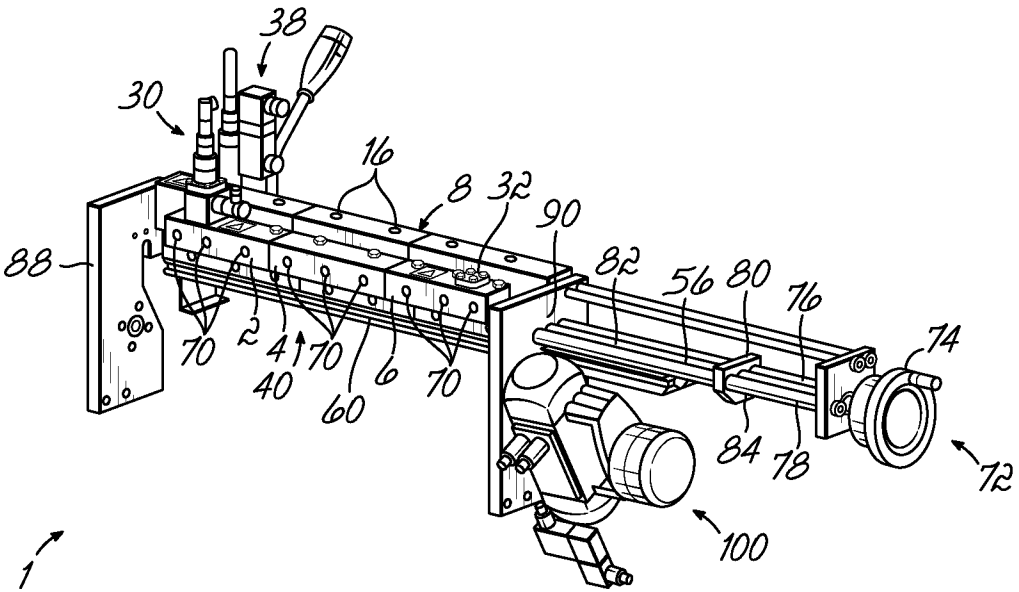
FIG. 1 is a first exemplary embodiment of a device for dispensing adhesive onto a substrate, in perspective depiction with the substrate guide device partially dismantled.

The depicted devices for dispensing fluids are used to apply hot melt adhesive to various substrates; however other fluids, in particular liquids, can also be dispensed and applied extensively to substrates. The devices shown are also referred to as application heads.

The first application head shown in FIGS. 1 through 4 has a basic body 8 assembled from three basic body segments 2, 4, 6 made of a metal material, in particular aluminum. The segments 2, 4, 6 are firmly screwed side-by-side by means of screw connections to a support profile shown in FIG. 4. To this end, at least two threaded bolts 12 per segment 2, 4, 6 are inserted through bores and screwed into sliding blocks 14 which are situated with a form fit inside of support profile 10. The bolts 12 can be inserted from above through bores 16 (FIG. 1) through which a tool is also insertable. The heads 12 of the installed bolts 12 are situated in an essentially rectangular recess 18 (FIG. 4) in the basic body segments 2, 4, 6.

On at least one basic body segment, segment 2 in the exemplary embodiment, a fluid filter 20 is screwed onto the side; it has a rectangular housing and is connectable by means of a threaded connection 22 (FIG. 2) to a fluid source (not shown), for example in the form of a drum melter. An outlet duct 24 of fluid filter 20, depicted in FIG. 4, communicates with an obliquely running fluid supply channel 26 (FIG. 4) formed in the basic body segment, which in turn leads into an essentially cylindrical bore 28 that is also formed in the basic body segment 2. Each of the basic body segments 2, 4, 6 may have one or two bores 28 to receive a fluid valve 30 (FIG. 4). In the exemplary embodiment, however, only the one bore 28 of segment 2 is provided with a fluid valve 30. All other bores 28 are closed by means of a sealing plug 32 (FIG. 3), since one fluid valve is sufficient for the operation of the device, as is described in greater detail below. It is also possible to employ a basic body segment 4 that has no bore to receive a fluid valve, as shown in FIG. 1. This can be varied depending on the application.

Fluid valve 30 serves to selectively interrupt or release the stream of adhesive, and is often also referred to as a controller or control module. Alternatively, a swivel closure or other closing element could also be utilized. Fluid valve 30 has a valve needle or a valve body 34 (FIG. 4) that is movable back and forth electropneumatically, so that it can be brought into contact with a valve seat 36 formed on the bore 28 to interrupt the flow of fluid. Fluid valve 30 can be actuated in a known manner with pressurized air, which can be added selectively by means of an electromagnetically operable valve 38.

A slotted nozzle assembly 40 with slot-shaped discharge opening 60 for dispensing the fluid is situated essentially entirely within a recess 42 of approximately rectangular cross section (FIG. 4) milled in the basic body segment 2, 4, 6, and is bolted to the latter by means of a plurality of bolts. It has two screw-connectable metal nozzle parts 44, 46 (FIGS. 3 and 4), each of which has a semicircular recess 48, 50 (FIG. 4), which together form a distribution channel 52. Distribution channel 52 extends essentially over the entire longitudinal extent of all basic body segments 2, 4, 6, and is sealed off laterally by a movable closing piece 54, which in turn is attached to one end of a bar 56. Distribution channel 52 is sealed off laterally at the opposite end by means of a fixed, abutting closing piece 58. Closing piece 54 and closing piece 58 have elongated sections 55 extending in the direction of the slot-shaped discharge opening 60, which provide for lateral sealing. Slot-shaped discharge opening 60 of nozzle assembly 40 extends essentially over the entire width of device 1.

Figure 3:
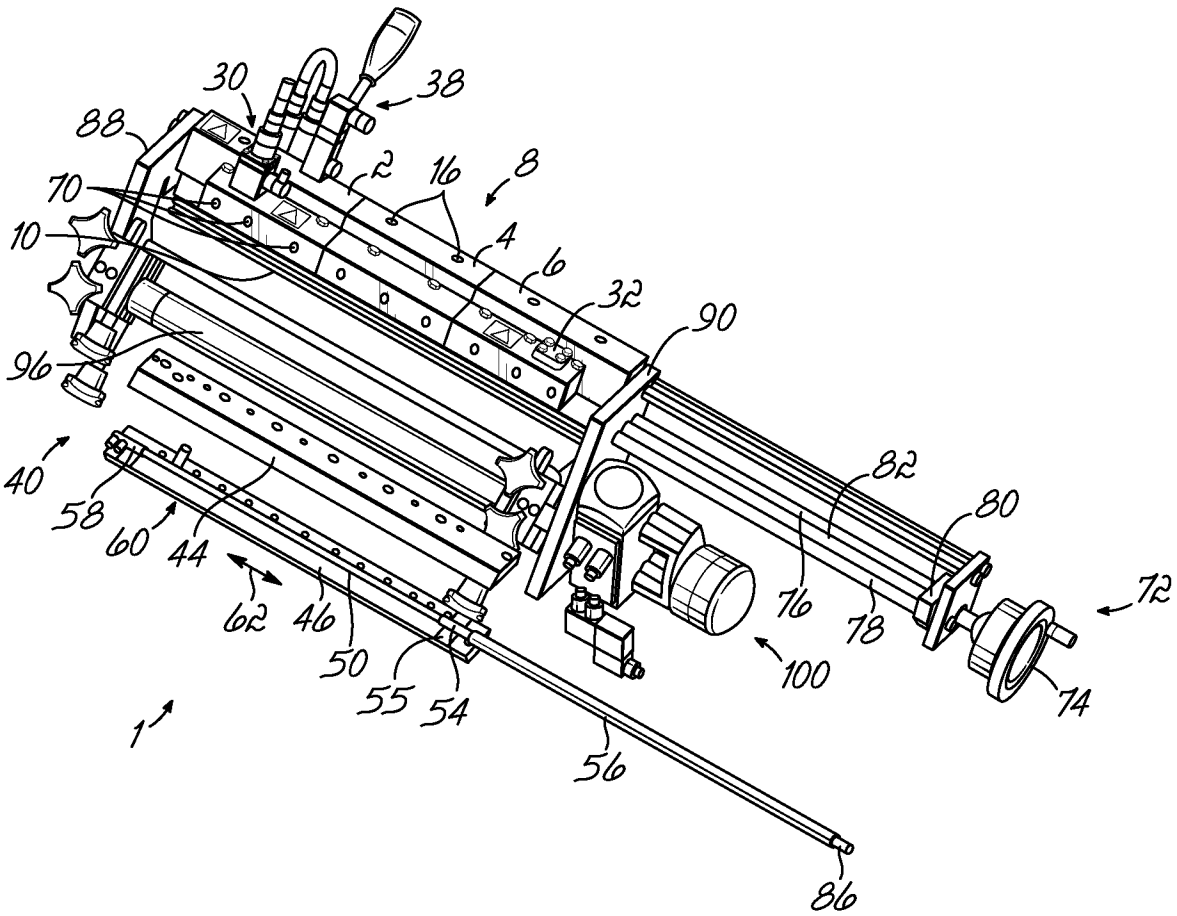
FIG. 3 is the device from FIG. 1 in an exploded perspective depiction.
Figure 4:
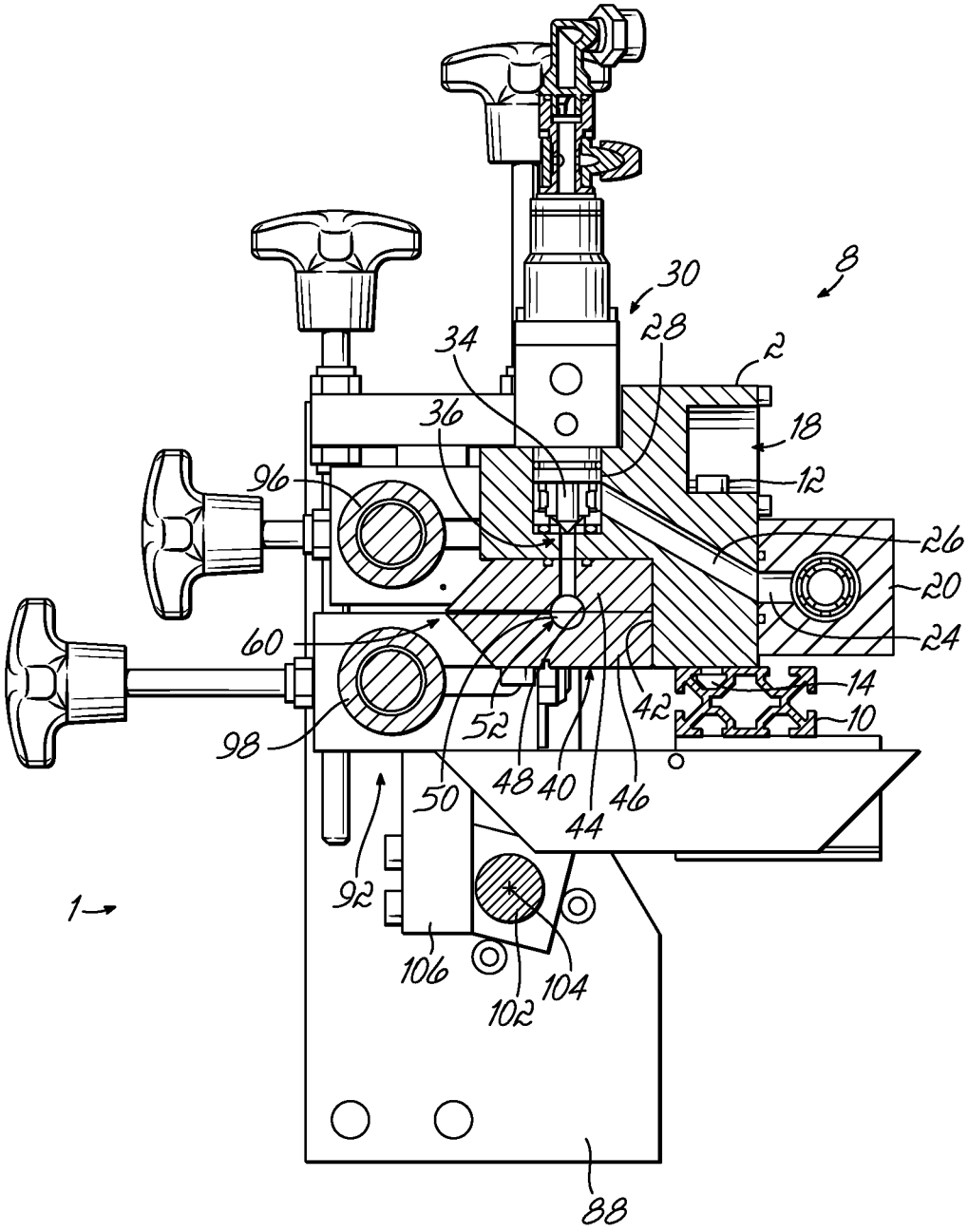
FIG. 4 is the device from FIG. 1 depicted in cross section in the area of the fluid valve.

As FIGS. 1 and 3 show, basic body 8 has a plurality of basic body segments 2, 4, 6, which are situated adjacent to each other and in the direction of the longitudinal extension 62 of slot-shaped discharge opening 60. Nozzle assembly 40 is in two parts, but in the exemplary embodiment shown is not divided into a plurality of segments in the direction of the longitudinal extension of the slot-shaped discharge opening. Instead, in the exemplary embodiment nozzle assembly 40 extends completely over the entire length of the modularly designed segmented basic body 8, in which the two nozzle parts 44, 46 extend over the entire length.

However in an alternative manner, not shown, slotted nozzle assembly 40 could be constructed equally well with a plurality of segments which are situated adjacent to each other and in the direction of the longitudinal extension of discharge opening 60. In that case the individual segments of nozzle assembly 40 would be sealed from each other, for example with the help of O rings of plastic or other materials which can be situated in recesses, in such a way that distribution channel 52 would be completely sealed and no fluid could escape from the seams or contact areas between the individual segments of nozzle assembly 40. However, the advantages according to the invention are also achieved even if only the basic body is of segmented design (segments 2, 4, 6), as depicted.

FIG. 1 illustrates that each basic body segment 2, 4, 6 has three bores 70 into which heating cartridges which are heated electrically are inserted, in order to heat basic body 8 and nozzle assembly 40. The electrical connecting lines to the heating cartridges are not shown.

Figure 2:
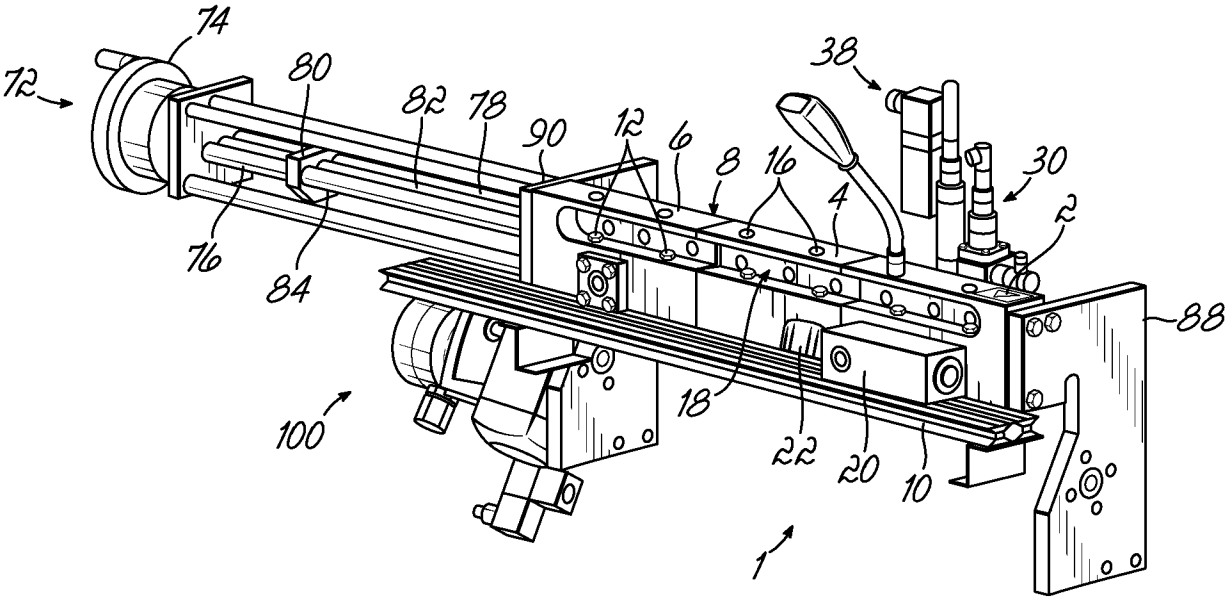
FIG. 2 is the device from FIG. 1 in a different perspective depiction.

An adjusting apparatus can be seen in FIGS. 1 through 3 that serves to set the effective length of distribution channel 52, in that the closing body 54 is movable back and forth axially with the bar 56 by means of a hand wheel 74. Adjusting apparatus 72 has two immovable guide rods 76, 78 (FIG. 3), along which a drive dog 80 can be moved. To move it, a threaded rod 82 is rotatably mounted and coupled with the hand wheel 74, so that by turning the hand wheel 74 and the threaded rod 82 it is possible to move the drive dog 80, which meshes with the threaded rod 82, axially. On its lower section, drive dog 80 has a slot 84, in which the back end 86 of rod 56 is inserted and axially fixed with a positive fit (FIG. 3). The rear end section 86 is stepped for this purpose. By turning hand wheel 74, drive dog 80 is thus moved axially together with the rod 56, and closing body 54 defines the effective length of distribution channel 52 in the particular position.

As FIGS. 1 through 4 also show, plate-like metal retaining plates 88, 90 are attached to the two ends of basic body 8 and support profile 10. They serve essentially to receive a substrate guide device 92 (FIG. 4) to guide a substrate past the discharge opening 60 of nozzle assembly 40 in a defined way. Substrate guide device 92 has two rotatable guide rollers 96, 98 which are mounted by means of needle bearings or other bearings. Substrate guide device 92 is not depicted completely in FIGS. 1 and 2. It also has a drive device 100 (FIG. 1) with an electric or pneumatic drive to turn an output shaft, which is coupled to a shaft 102 shown in FIG. 4. Shaft 102 is supported on the side parts 88, 90 so that it can turn around an axis of rotation 104, and is screwed in a rotationally fixed attachment to a holding lever 106, which in turn receives the rollers 96, 98. When drive 100 is actuated, the rollers 96, 98 together with holding lever 106 are pivoted around the axis of rotation 104 and thus are pivoted toward the discharge opening or away from it, in order to guide the substrate accordingly.

Figure 5:
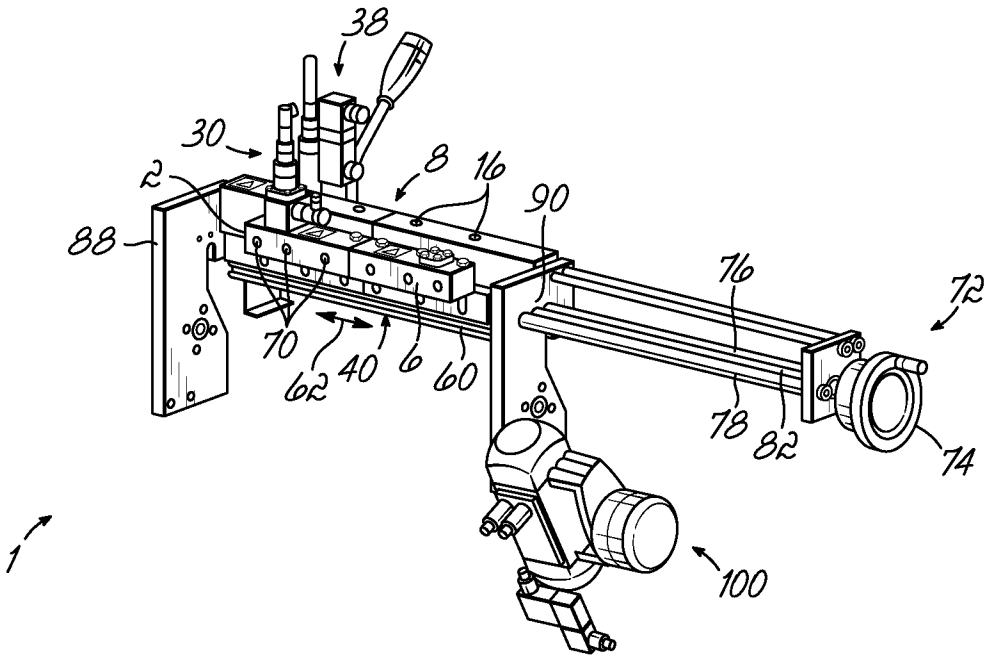
FIG. 5 is a second exemplary embodiment of a device for dispensing fluid in perspective depiction.

The alternative exemplary embodiment shown in FIG. 5 is very similar to the exemplary embodiment already shown, and to avoid repetitions we refer to the above descriptions and figures entirely. The same reference labels have been used for like or functionally equivalent parts. The deviating features are described below. The exemplary embodiment shown in FIG. 5 differs from the one described earlier in that not three but two basic body segments 2, 6 form the complete basic body 8. The total maximum application width is thereby reduced by one third compared to the first exemplary embodiment.

Figure 6:
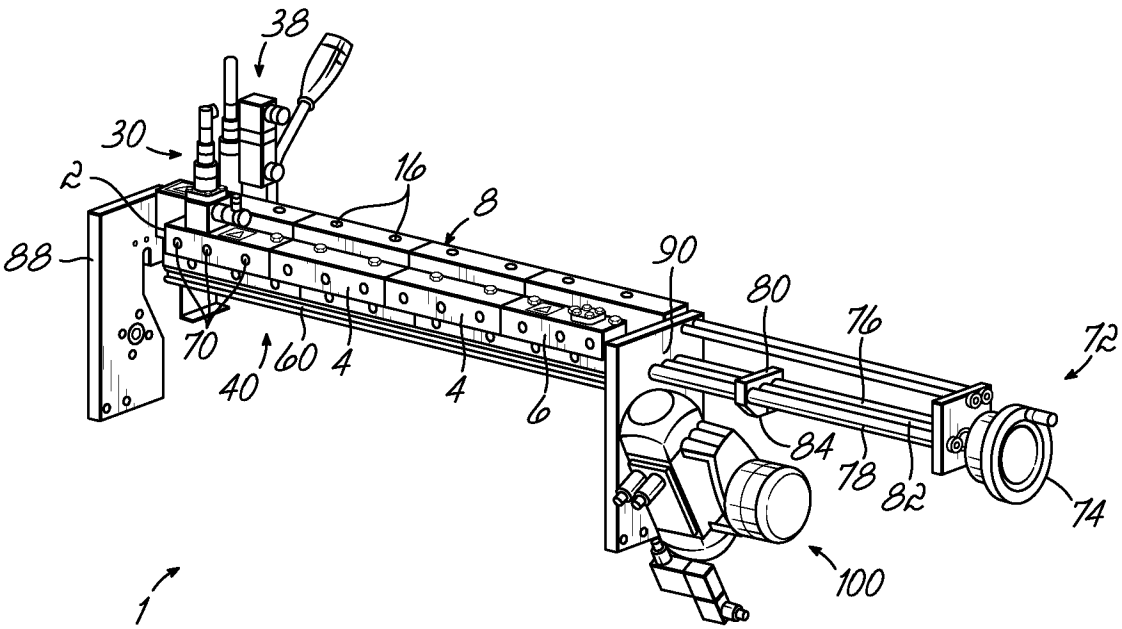
FIG. 6 is a third exemplary embodiment of a device for dispensing fluid in perspective depiction.

The alternative exemplary embodiment shown in FIG. 6 is very similar to the exemplary embodiment already shown, and to avoid repetitions we refer to the above descriptions and figures entirely. The same reference labels have been used for like or functionally equivalent parts. The deviating features are described below. The exemplary embodiment shown in FIG. 6 differs from the one described earlier in that four basic body segments 2, 4, 4, 6 form the complete basic body 8. The total maximum application width is enlarged thereby compared to the first and second exemplary embodiments.

While the present invention has been illustrated by a description of various embodiments and while these embodiments have been described in some detail, it is not the intention of the Applicants to restrict or in any way limit the scope of the appended claims to such detail. Additional advantages and modifications will readily appear to those skilled in the art. The various features disclosed herein may be used alone or in any combination depending on the needs and preferences of the user. The scope of the invention itself should only be defined by the appended claims.

What is claimed is:

1. A device for dispensing adhesive onto a moving substrate, the device comprising:

a basic body defining a longitudinal direction and including at least two basic body segments, each of said basic body segments including first and second ends oriented transverse to the longitudinal direction and spaced from each other in the longitudinal direction, each of said basic body segments also including a fluid supply channel adapted to be coupled with a fluid source, said basic body segments positioned in side-by-side relationship along the longitudinal direction such that said first end of a first basic body segment and said second end of a second basic body segment adjacent said first basic body segment face towards each other in opposing directions along the longitudinal direction;

a nozzle assembly including first and second nozzle parts extending along an entire length of said basic body along the longitudinal direction and coupled to each of said at least two basic body segments, said nozzle assembly including a distribution channel coupled into communication with said fluid supply channel of each of said basic body segments, said nozzle assembly further including a unitary slot-shaped discharge outlet coupled into communication with said distribution channel and extending along the longitudinal direction; and a fluid valve coupled to one said fluid supply channel of said basic body segments, said fluid valve operable to selectively interrupt fluid flow from the fluid source to said distribution channel; and a stationary support profile extending along the longitudinal direction, wherein each of said basic body segments is fixedly coupled to said support profile to operatively couple each of said basic body segments, said support profile defining an elongated separate element from the fluid source and said nozzle assembly, and said support profile having no fluid communication with said basic body and said nozzle assembly, wherein said support profile includes an elongated channel, and the device further comprises:

sliding blocks inserted in a form fit within said elongated channel of said support profile, said sliding blocks being fixedly coupled to said basic body segments to operatively couple said basic body segments together and to said support profile.

2. A device for dispensing adhesive onto a moving substrate, the device comprising:

a basic body defining a longitudinal direction and including at least two basic body segments, each of said basic body segments including first and second ends oriented transverse to the longitudinal direction and spaced from each other in the longitudinal direction, each of said basic body segments also including a fluid supply channel adapted to be coupled with a fluid source, said basic body segments positioned in side-by-side relationship along the longitudinal direction such that said first end of a first basic body segment and said second end of a second basic body segment adjacent said first basic body segment face towards each other in opposing directions along the longitudinal direction;

a nozzle assembly extending along the longitudinal direction and coupled to each of said at least two basic body segments, said nozzle assembly including a distribution channel coupled into communication with said fluid supply channel of each of said basic body segments, said nozzle assembly further including a slot-shaped discharge outlet coupled into communication with said distribution channel and extending along the longitudinal direction;

a fluid valve coupled to at least one said fluid supply channel of said basic body segments, said fluid valve operable to selectively interrupt fluid flow from the fluid source to said distribution channel; and a stationary support profile extending along the longitudinal direction, wherein each of said basic body segments is fixedly coupled to said support profile to operatively couple each of said basic body segments, said support profile defining an elongated separate element from the fluid source and said nozzle assembly, and said support profile having no fluid communication with said basic body and said nozzle assembly, wherein said support profile includes an elongated channel, and the device further comprises:

sliding blocks inserted in a form fit within said elongated channel of said support profile, said sliding blocks being fixedly coupled to said basic body segments to operatively couple said basic body segments together and to said support profile.

3. The device of claim 1, wherein said first and second nozzle parts are divided into at least two nozzle segments positioned in side-by-side relationship along the longitudinal direction.

4. The device of claim 1, wherein said first and second nozzle parts include corresponding grooves facing towards each other to define said distribution channel and said slot-shaped discharge outlet.

5. The device of claim 4, further comprising:

a closing member positioned within said distribution channel between said first and second nozzle parts, said closing member being movable within said distribution channel to adjust an effective length of said distribution channel along the longitudinal direction.

6. The device of claim 5, wherein said closing member further includes a projection that extends through said slot-shaped discharge outlet such that movement of said closing member adjusts an effective length of said slot-shaped discharge outlet along the longitudinal direction.

7. The device of claim 1, wherein said basic body includes a recess extending along the longitudinal direction, and said nozzle assembly is positioned within said recess when said nozzle assembly is coupled to each of said basic body segments.

8. The device of claim 1, wherein each of said basic body segments includes at least one bore in communication with said fluid supply channel of said corresponding basic body segments and adapted to receive said fluid valve, wherein said at least one bore is adapted to be plugged when said fluid valve is not positioned in said at least one bore.

9. The device of claim 1, wherein said fluid valve includes a movable valve body and said basic body segments include a valve seat, said movable valve body adapted to contact said valve seat to interrupt the fluid flow.

10. The device of claim 1, further comprising:

a fluid filter coupled to one of said basic body segments, said fluid filter adapted to filter fluid flow between the fluid source and said fluid valve coupled to the one said fluid supply channel.

11. The device of claim 1, wherein each of said basic body segments further includes at least one heating cartridge bore adapted to receive heating cartridges operable to heat said basic body and said nozzle assembly.

12. The device of claim 1, further comprising:

a holding element coupled to opposing ends of said basic body; and a substrate guide device coupled to said holding element and operable to guide the moving substrate past said slot-shaped discharge outlet.

13. The device of claim 12, wherein said substrate guide device is pivotable about an axis of rotation such that the moving substrate is movable with respect to said slot-shaped discharge outlet.

* * * * *